US006513650B2

(12) United States Patent
Mollstam et al.

(10) Patent No.: US 6,513,650 B2
(45) Date of Patent: Feb. 4, 2003

(54) TWO-COMPARTMENT CONTAINER

(75) Inventors: Bo Mollstam, Lerum (SE); Ivan A. Casas, Raleigh, NC (US); Fredrik Magnusson, Stockholm (SE); Karin Oberg, Hagersten (SE); Filip Sauer, Stockholm (SE)

(73) Assignee: Biogaia AB, Stockholm (SE)

( * ) Notice: Subject to any disclaimer, the term of this patent is extended or adjusted under 35 U.S.C. 154(b) by 0 days.

(21) Appl. No.: 09/855,252

(22) Filed: May 15, 2001

(65) Prior Publication Data

US 2002/0040856 A1 Apr. 11, 2002

Related U.S. Application Data

(60) Continuation-in-part of application No. 09/592,217, filed on Jun. 12, 2000, now abandoned, which is a division of application No. 09/265,453, filed on Mar. 10, 1999, now Pat. No. 6,098,795, and a continuation-in-part of application No. 09/775,486, filed on Feb. 1, 2001, which is a division of application No. 09/598,792, filed on Jun. 21, 2000, now Pat. No. 6,209,718, which is a division of application No. 08/949,465, filed on Oct. 14, 1997, now Pat. No. 6,105,760.

(51) Int. Cl.[7] ..... B65D 25/08

(52) U.S. Cl. ..... 206/222; 206/219

(58) Field of Search ..... 206/219, 229, 206/222; 215/DIG. 8; 222/80

(56) References Cited

U.S. PATENT DOCUMENTS

| | | | | |
|---|---|---|---|---|
| 2,631,521 A | | 3/1953 | Atkins, Jr. | |
| 3,220,588 A | * | 11/1965 | Lipari | 206/222 |
| 3,326,363 A | | 6/1967 | Bennett et al. | |
| 3,349,965 A | | 10/1967 | Krugger | |
| 3,406,872 A | * | 10/1968 | Fiquet et al. | 222/499 |
| 3,415,360 A | | 12/1968 | Baumann et al. | |
| 3,779,372 A | | 12/1973 | de Lloret | |
| 3,968,820 A | | 7/1976 | Kolb et al. | |
| 4,074,827 A | | 2/1978 | Labe, III | |
| 4,609,369 A | | 9/1986 | Ball | |
| 4,640,424 A | * | 2/1987 | White | 215/11.1 |
| 4,770,305 A | * | 9/1988 | Su | 215/250 |
| 4,785,931 A | | 11/1988 | Weir et al. | |
| 4,874,618 A | | 10/1989 | Seaborne et al. | |
| 5,035,320 A | | 7/1991 | Plone | |
| 5,255,812 A | | 10/1993 | Hsu | |
| 5,290,574 A | | 3/1994 | Jamieson et al. | |
| 5,370,222 A | | 12/1994 | Steigerwald et al. | |
| 5,419,429 A | | 5/1995 | Zimmerman et al. | |
| 5,884,759 A | | 3/1999 | Gueret | |
| 6,003,728 A | * | 12/1999 | Elliott | 206/219 |

FOREIGN PATENT DOCUMENTS

| | | |
|---|---|---|
| FR | 74 37170 | 4/1976 |
| JP | 91-167116/23 | 8/1990 |

* cited by examiner

*Primary Examiner*—David T. Fidei
(74) *Attorney, Agent, or Firm*—Lynn E. Barber

(57) ABSTRACT

A two-compartment container in which the first compartment has an upper layer and a lower layer and contains a first component that is to be added to the second compartment. Above the first compartment is a dome that is bowed upward and is flexible. Attached to the dome is a cutting means. Depressing the dome by pushing downward on it lowers the cutting means so that both the upper and lower layer of the first compartment are cut by the cutting means, releasing the first component into the second compartment. The cutting means may be a simple puncturer, or in the case where the second compartment comprises a beverage container or the like, the cutting means may be part of a tubular wall surrounding the opening through which someone can drink the beverage.

10 Claims, 2 Drawing Sheets

TWO-COMPARTMENT CONTAINER

CROSS-REFERENCE TO RELATED APPLICATIONS

This is a continuation-in-part of co-pending application Ser. No. 09/592,217, filed Jun. 12, 2000 (abandoned after the filing of the instant application), which is a divisional application of application Ser. No. 09/265,453, filed Mar. 10, 1999 (now U.S. Pat. No. 6,098,795 issued Aug. 8, 2000), and a continuation-in-part of co-pending application Ser. No. 09/775,486, filed Feb. 1, 2001, which is a divisional application of application Ser. No. 09/598,792 filed Jun. 21, 2000 (now U.S. Pat. No. 6,209,718 issued Apr. 3, 2001), which is a divisional application of application Ser. No. 08/949,465, filed Oct. 14, 1997 (now U.S. Pat. No. 6,105, 760 issued Aug. 22, 2000), the disclosure of which applications and patents is incorporated herein by reference.

BACKGROUND OF THE INVENTION

1. Field of the Invention

This invention relates to packages and containers, and in particular, pertains to containers having two compartments and that may be used to keep two components separate until use.

2. Description of the Related Art

Many different types of packages have been designed to enable product components to be kept separate until use and, in some cases, to allow one component to remain sterile until use of the product. In one type of two-compartment package, a stopper or other means is placed in the hole between the two compartments. For example, the two-compartment container of Halm (U.S. Pat. No. 5,417,321) comprises a one-piece container having two compartments assembled one upon another interlinked by a stoppered opening. The disclosure of all patents referred to herein is incorporated herein by reference.

Other two-compartment packages utilize a perforating unit to allow the two previously separated components to mix. See, for example, the patents of Goncalves (U.S. Pat. No. 5,170,888 which has a glass defining a first compartment, which is provided with a neck upon which is mounted a bottle defining a second compartment, with a membrane between the two compartments that is perforated when a perforating unit is displaced relative to the glass, and U.S. Pat. No. 4,757,916 which has two units separated by a cover perforatable as a result of the manipulation of a mixing perforator). The two-part container of Wiegner (U.S. Pat. No. 4,103,772) has a frangible partition of coated aluminum foil dividing the compartments and a piercing member mounted on a resilient portion transversely directed toward the partition. In the patent of White (U.S. Pat. No. 4,637, 934) rigid penetrating means are used to penetrate a compartment closing diaphragm to allow nursing liquid to flow from the compartment to a communicating, attached nipple.

Two compartment packages have also been previously developed which have an opening container attached to the top of the package and are provided with a screw cap and a cylinder jacket shaped supporting ring. The cylinder jacket shaped supporting ring is attached to the top of the package by means of a fixing flange externally surrounding the opening disc and is provided on its inner surface with a raised thread. The ring surrounds the external thread of the plastic screw cap. A cutter is integrally molded onto the free edge of the screw cap, and is provided with a front cutting edge which passes at an angle through the free edge.

For such products as two-part epoxy glues, two compartments are also needed to keep the products from reacting, as in the patent of Wilkinson et al. (U.S. Pat. No. 4,786,279).

The dispenser of Renault (U.S. Pat. No. 5,564,600) has two compartments separated by a sealing member sealed against a seat, so that movement of one of the containers relative to the other causes the sealing member to move away from the seat and form an annular passage between the sealing member and the seat.

U.S. Pat. Nos. 6,209,718 and 6,105,760 and the co-pending application (Ser. No. 09/775,486) disclose a two-compartment package, which keeps a first component separate from a liquid component until use, so that the first component does not become wetted until just before use. The two-compartment package keeps at least one of the components sterile until just before use, at or before which time, the two components may be easily mixed. The prior invention can thus be used for containers for the separate packaging of dried microbial cultures which are to be added to a food, liquid nutrition, medicine, or beverage product just before consumption, for the separate packaging of carbonation tablets from a liquid until just before consumption and for separate packaging of vitamins or other unstable components before addition to a beverage, liquid nutrition, medicine or beverage before consumption.

U.S. Pat. No. 6,098,795 and the co-pending application (Ser. No. 09/592,217) disclose a container and means for adding a selected component to a main package, thus forming a two-compartment container that keeps a first component, which may, for example, be moisture sensitive, from a second component, preferably a liquid, until a selected time before use. The delivery package, preferably containing a second component in a compartment inside a cavity in the delivery package, may be mountable on the outside surface of a main package. A puncture means is provided for cutting through the compartment and the main package to gain access to the main package, for example, to release the first component from the compartment into the main package. Alternatively, the main package may be a bag, such as an enteral bag in the preferred use of the first embodiment. In the second embodiment of the invention, the main package preferably is for holding a liquid beverage, and the delivery package is attached to the main package during the manufacturing process.

In some cases, such as with aseptically-filled bottles or cartons, there is a need to provide a means for adding a selected separate first component to a package after manufacture of the package and/or at a location on the package, which component may vary in concentration and/or composition, depending, for example, on the patient's history and diagnosis. Providing a means of attaching a first compartment to a package after both the first compartment and package have been manufactured allows a user to select both a particular first component to add to a package and the time and place of addition of the first component to the package. There is also need to have the capability to add beverage additives, particularly degradable or moisture-sensitive or oxygen-sensitive components (for example, vitamins) to liquid beverage bottles at or just before the time the beverage is consumed.

The types of structures used for many prior two-compartment containers are complicated and often subject to leakage. Thus, there remains a need to have two-compartment packages which keep a first component separate from a liquid component until use, so that the first component does not become wetted until just before use, that keep at least one of the components sterile until just before use, and in which the two components may be easily mixed just before use, and which has minimal or no leakage prior to mixing of the components and once the components have been mixed. For example, there is a need for such containers for the separate packaging of dried microbial cultures which are to be added to a food, liquid nutrition, medicine, or beverage product just before consumption, for the separate packaging of carbonation tablets from a liquid until just before consumption, and for separate packaging of vitamins or other unstable components before addition to a beverage, liquid nutrition, medicine or beverage before consumption.

It is therefore an object of the invention to provide a two-compartment container that keeps a first component, which may be moisture sensitive, from a second component, preferably a liquid, until a selected time before use.

It is a further object of the invention to provide a two-compartment container that has improved manufacturability and decreased leakage.

Other objects and advantages will be more fully apparent from the following disclosure and appended claims.

SUMMARY OF THE INVENTION

The invention herein is a two-compartment container. The first compartment has an upper layer and a lower layer and contains a first component that is to be added to the second compartment. Above the first compartment is a dome that is bowed upward and is flexible. Below the dome is a cutting means, preferably formed in one piece with the dome. Depressing the dome by pushing downward on it lowers the cutting means so that both the upper and lower layer of the first compartment are cut by the cutting means, releasing the first component into the second compartment. The cutting means may be a simple puncturer, or in the case where the second compartment comprises a beverage container or the like, the cutting means may be the lower part of a wall surrounding the opening through which someone can drink the beverage.

Other objects and features of the inventions will be more fully apparent from the following disclosure and appended claims.

DETAILED DESCRIPTION OF THE INVENTION AND PREFERRED EMBODIMENTS THEREOF

Figure 1:
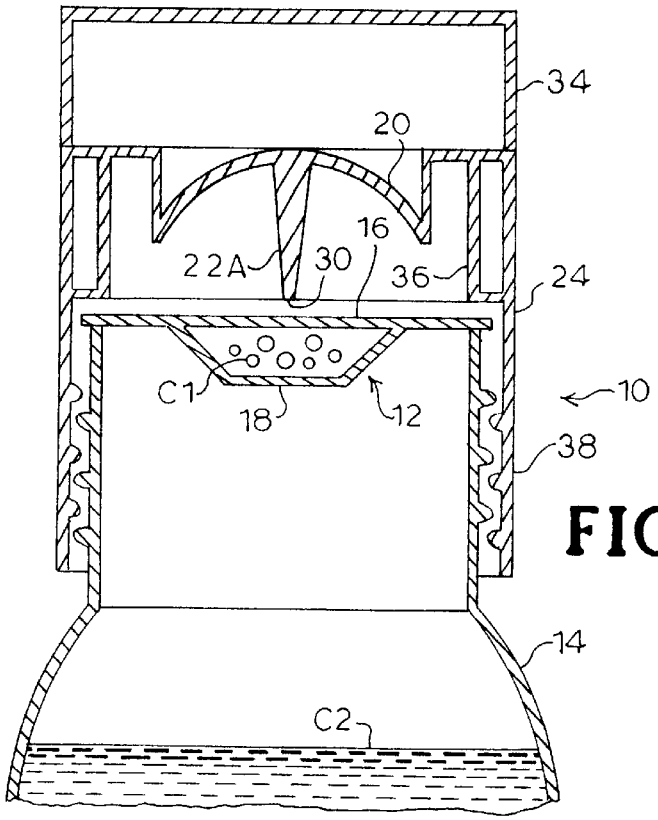
FIG. 1 is a cross-sectional view of the first embodiment of the invention showing the dome when not depressed.

The present invention provides an improved two-compartment container having a cutting means to release a sensitive component from a first compartment into a second compartment, with minimal or no possibility of leakage around the cutting means or the opening of the second compartment.

As used herein, the relative directional terms "above", "below" and the like are used to specify the relative orientations of the parts of the invention when the container is a bottle, carton or the like oriented having the opening of the second compartment facing upward. In particular structures or usages of the container of the invention, the container may be oriented in other manners without departing from the invention herein, and it is understood that in such instances, the actual orientation of the parts of the invention are correspondingly changed.

In particular, the invention herein is container 10 comprising a first compartment 12 and a second compartment 14 (FIGS. 1–4). Although generally the second compartment 14 serves as the main compartment containing second component C2 that is normally a liquid, and the first compartment 12 serves as a delivery package for a first component C1 to be added to the second compartment 14, it is understood that by use of the terms "main" package and "delivery" package as used herein, no limitation is placed on the absolute or relative sizes of the packages. The terms are used merely to distinguish the two packages by difference in function and structural characteristics, with the main package including packages known in the prior art for holding substances and the delivery package preferably designed for holding a first component to be added to the main package. In the preferred embodiments herein, the second compartment 12 is a screw-capped bottle or a carton.

The first compartment 12 has an upper layer 16 and a lower layer 18 and contains a first component C1 that is to be added to the second compartment 14. The structure of the first compartment 12 is preferably similar to those disclosed in the parent applications hereto, the disclosure of which is incorporated herein by reference. Thus, a preferred first compartment 12 is preferably made of foil, and most preferably of foil having a plastic layer on one surface on the outside of the compartment, such as a polyethylene laminated aluminum foil, for example, Catalog No. PETP12 of Danisco (Allborg, Denmark).

Above the first compartment 12 is a dome 20 that is part of the cap 24 covering the second compartment 14 and that is bowed upward and is flexible. Preferably, the dome 20 is formed of a thin flexible plastic material, as is known in the art. Extending below the dome 20 is a cutting means 22A,B, which is most preferably an integral part of the dome 20, but made of a shape, size and rigidity to enable piercing of upper layer 16 and lower layer 18. Collar 36 extending above a threaded area 38 of the cap 24 holds the dome 20 suspended over the second compartment 14. Thus, in use of the invention, depressing the dome 20 by pushing downward on it lowers the cutting means 22A,B within the collar 36 so that both the upper layer 16 and lower layer 18 of the first compartment 12 are cut by the cutting means 22A,B, releasing the first component C1 into the second compartment 14. This structure enables up and down movement of the cutting means 22A,B inside the container 10, which unlike the prior art, has no part moving inside another where there might be leakage from the outer part due to the movement.

Figure 2:
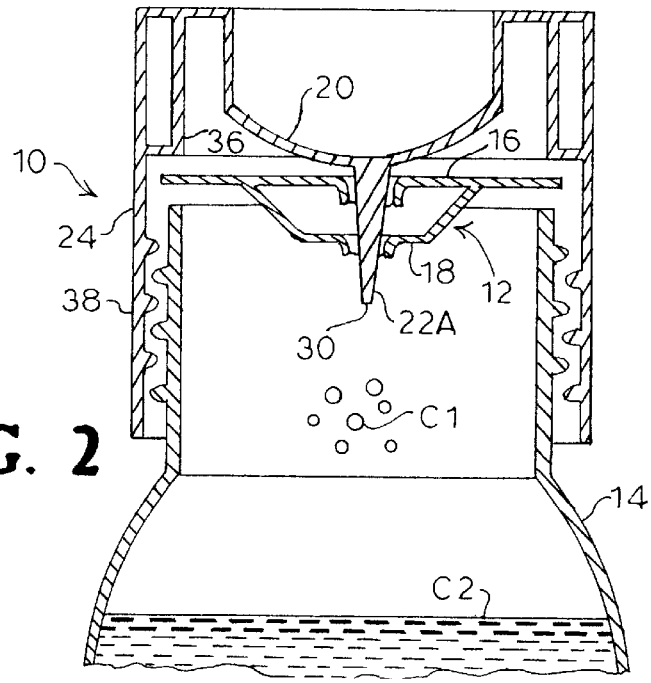
FIG. 2 is a cross-sectional view of the first embodiment of the invention showing the dome when depressed.

In the first embodiment of the invention herein, shown in FIGS. 1–2, the cutting means 20 is a simple puncturer 22A that protrudes downward from the dome 20. The configuration of the cutting means 22A may be tailored for different types of puncturable materials. Preferably, the pointed end 30 is a simple conical shape without protrusions or alternatively, the pointed end 30 may be conical with a serrated or scalloped cross-section as in the parent applications. As shown in FIG. 2, depressing the dome 20 causes the simple puncturer 22A to be pushed through both the upper layer 16 and the lower layer 18. so that first component C1 is released into the second compartment 14.

Figure 3:
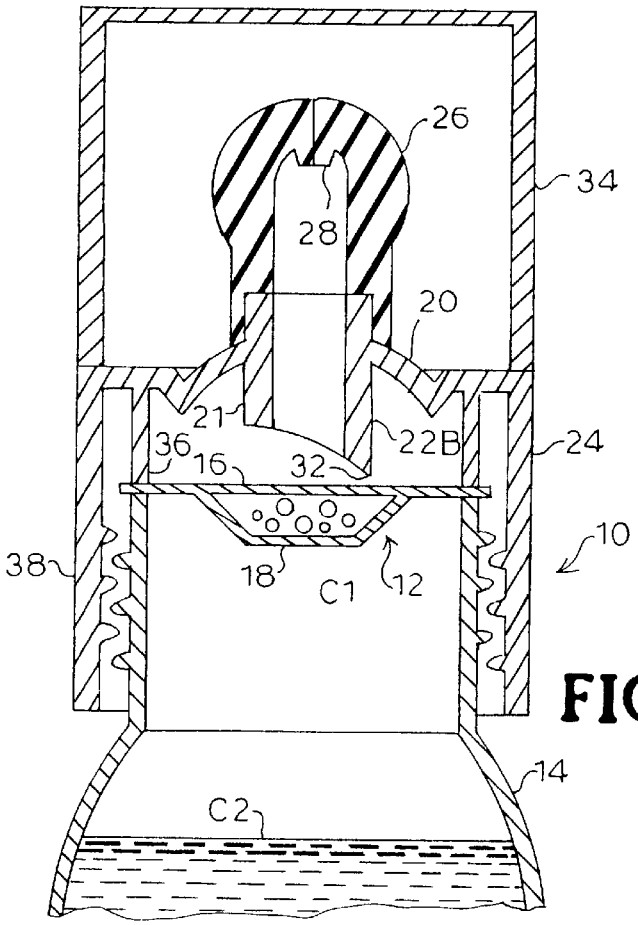
FIG. 3 is a cross-sectional view of the second embodiment of the invention showing the dome when not depressed.
Figure 4:
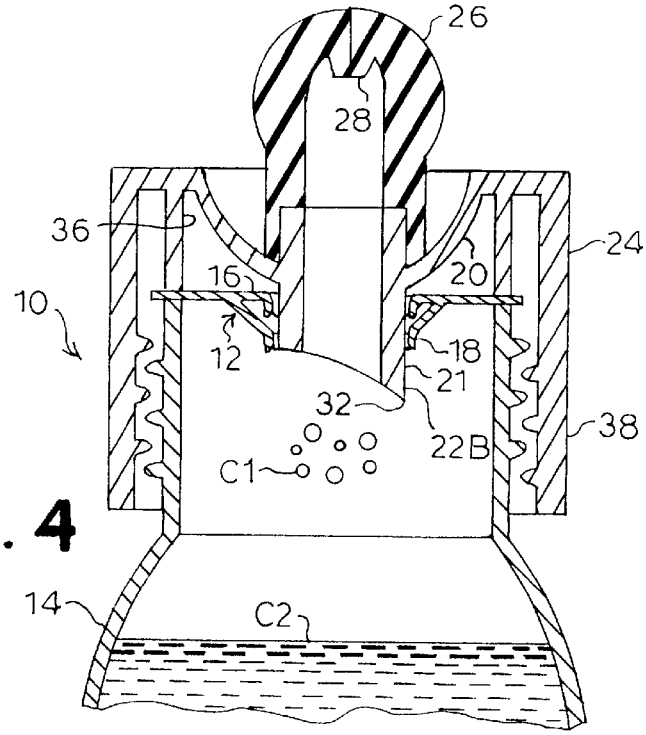
FIG. 4 is a cross-sectional view of the second embodiment of the invention showing the dome when depressed.

In the second embodiment of the invention (FIGS. 3–4), which is particularly useful where the second compartment 14 comprises a beverage container or the like, the cutting means 22B may be part of a wall surrounding the opening through which someone can drink the beverage. Thus, as shown in FIG. 3, in this embodiment, the dome 20 is preferably located on the top of the cap 24 of the beverage container. The dome in this embodiment has a central opening surrounded by a tube 21. The bottom of the tube 21 comes to a point 32, which forms the cutting means 22B in this embodiment. Point 32 may be any shape that is able to puncture the upper layer 16 and the lower layer 18. Over the tube 21, a nipple 26 through which liquid can be withdrawn, and having inner lips 28 to seal the opening as is known in the art, is placed to keep the package from leaking when not in use. Depressing the dome 20 lowers the cutting means 22B as the tube 21 is lowered, thus puncturing both the upper layer 16 and lower layer 18 of the first compartment 12. Nipple 26 closes by itself when not in use, and pressure from inside the container 10 increases the extent of closure of the nipple 26.

In both embodiments, there is preferably an outer cap 34 over the cap 24, as shown in FIGS. 1 and 3, which prevents accidental depression of the dome 20 prior to use, such as during shipping and storage.

The invention is primarily designed for addition of a selected, sensitive first component C1, preferably located in first compartment 12, to a liquid located in the main package (second compartment 14). The term "selected" first component C1 as used herein includes first component(s) chosen for a particular use, e.g., addition to a bottle or carton to be used by a person requiring additional vitamins or antibiotics, or having a particular volume or concentration, and the like. The first component may be a single compound, mixture, solution, capsule, powder, or any other containable component(s) to be added to a main package that preferably contains a second component (which may in turn be any containable compound(s) to which the first component may be added to result in a useful product. The ability to select from an assortment of pre-packaged first components in the first embodiment herein allows the purchaser to purchase and store first and second components separately, for example, to keep non-perishable second components at room-temperature, and to keep first compartments, each of which has one of any number of assorted first components under appropriate, possibly separate, storage, for later addition to the second component. When the first component C1 comprises microorganism cells, the first component is preferably in a powdered formulation as described in the parent applications hereto.

The term "sensitive" includes first components which are moisture-sensitive, or which interact with the second component, for example, by forming by-products that change the usefulness of the combined components, for example, from initially useful to too weak, due, for example, to loss or change of strength or value with time after the combination of components. "Sensitive" first components also include those components that may require special storage and/or handling until just before addition to a second component, for example, refrigeration, desiccation, or heating; as well as first components that for any other reason(s) are desired to be kept separate from a second component between the time of manufacture and until a later time, such as the time of addition to a second component.

It is preferred that the first component be in the form of a powder that is stable when dry and that is easily dissolved or suspended in the liquid in the main package as disclosed in the parent applications hereto. The invention is particularly useful for adding unstable and/or sterile components to a beverage, liquid enteral nutrition or medicine, for example, adding vitamins or beneficial gastrointestinal microorganisms, such as Lactobacillus reuteri, to fruit juice, milk, water, and medicine.

While the invention has been described with reference to specific embodiments, it will be appreciated that numerous variations, modifications, and embodiments are possible, and accordingly , all such variations, modifications, and embodiments are to be regarded as being within the spirit and scope of the invention.

What is claimed is:

1. A two-compartment container, for addition of a first component to a second component, comprising:

(a) a first compartment containing a first component, said first compartment having an upper layer and a lower layer, said first compartment being made of a cuttable material;

(b) a second compartment containing the second component, said second compartment having a cap containing a flexible dome and having a cutting means protruding from below the flexible dome toward the first compartment upper layer of the first compartment;

wherein depression of said flexible dome causes the cutting means to cut through the upper layer and the lower layer, releasing the first component into the second compartment.

2. The container according to claim 1, wherein the cutting means is a projection attached to the flexible dome.

3. The container according to claim 1, wherein the cutting means has a conical pointed end.

4. The container according to claim 1, wherein the cap has a central opening surrounded by a tube having a lower end extending below the cap, and wherein the cutting means is part of the lower end.

5. The container according to claim 1, wherein the flexible dome and the cutting means are integrally formed.

6. A method of forming a two-part container, comprising:

(a) providing a first compartment containing a first component, said first compartment having an upper layer and a lower layer, said first compartment being made of a cuttable material;

(b) providing a second compartment containing the second component, said second compartment having a cap containing a flexible dome and having a cutting means protruding from below the flexible dome toward the first compartment upper layer of the first compartment; and (c) depressing said flexible dome to cause the cutting means to cut through the upper layer and the lower layer, releasing the first component into the second compartment.

7. The method according to claim 6, wherein the cutting means is a projection attached to the flexible dome.

8. The method according to claim 6, wherein the cap has a central opening surrounded by a tube having a lower end, and wherein the cutting means is part of the lower end.

9. The method according to claim 6, wherein the flexible dome and the cutting means are integrally formed.

10. The method according to claim 6, wherein the cutting means has a conical pointed end.

* * * * *